United States Patent [19]

Richie

[11] 4,296,280

[45] Oct. 20, 1981

[54] WALL MOUNTED SPEAKER SYSTEM

[76] Inventor: Ronald A. Richie, 5527 S. Braeswood, Houston, Tex. 77096

[21] Appl. No.: 131,264

[22] Filed: Mar. 17, 1980

[51] Int. Cl.[3] ..... H04R 1/02

[52] U.S. Cl. ..... 179/1 E; 179/146 E; 181/150; 181/156

[58] Field of Search ..... 179/1 E, 146 E; 181/148, 150, 156, 199

[56] References Cited

U.S. PATENT DOCUMENTS

| | | | |
|---|---|---|---|
| 1,741,274 | 12/1929 | Baumann | 181/156 |
| 1,887,185 | 11/1932 | Quinby | 181/150 |
| 2,457,029 | 12/1948 | Brockway | 181/150 |
| 2,744,584 | 5/1956 | Hellon | 181/150 |
| 2,821,260 | 1/1958 | Shaffer | 181/150 |

OTHER PUBLICATIONS

Audio Engineering, Jan. 1952, pp. 20, 21, 43, 44, Music's the Thing, Greene et al.

*Primary Examiner*—George G. Stellar

*Attorney, Agent, or Firm*—Arnold, White & Durkee

[57] ABSTRACT

A high-fidelity speaker arrangement suitable for mounting in the wall structure of a wall is disclosed. A bass reflex speaker enclosure containing a plurality of speakers and an associated cross-over network comprises the speaker assembly to be mounted in the wall structure. A mounting assembly adapted for mounting between adjacent wall studs is secured to at least one of the wall studs and receives therein the speaker enclosure. Both the mounting assembly and the speaker assembly have a depth dimension that is substantially equal to the depth of a standard wall stud, and a width dimension substantially equal to the nominal inside spacing between adjacent wall studs. A trim frame and removable cover grille is provided to finish the mounted speaker arrangement. When mounted, the speaker arrangement gives the appearance of being substantially a continuation of the surface of the wall while enabling the speaker enclosure to provide full range high-fidelity sound reproduction into the room.

12 Claims, 3 Drawing Figures

18
19
2
14
12
3
2
E
1
21
13
8
9
11
10
22
13
21
1

18
17
20
5
1
19
B
2
A
D
15
21
7
C
4
13
4
8
11
12
14
24
10
6
3
13
9
23
23
22
23
23

| COMPONENT | EMBODIMENT 1 | 2 | 3 |
|---|---|---|---|
| LW (mh) | 1.5 | .75<br>.75 | .75<br>.75<br>75 |
| LM (mh) | .25 | .1 | .25<br>.25 |
| CM (MFD) | 25 | 50 | 50<br>12 |
| LT (mh) | 4 | 10<br>8 | 12<br>8<br>6 |

WALL MOUNTED SPEAKER SYSTEM

BACKGROUND OF THE INVENTION

This invention relates to full range high-fidelity speaker system installations. More particularly, the invention relates to a speaker arrangement that is adapted for installation in the nominal spacing between adjacent wall studs of a home, and where the depth of the speaker enclosure is no greater than the nominal width of a standard 2×4 inch wall stud, the exterior surfaces of the mounted speaker arrangement appearing to be substantially flush to the wall.

Most modern stereo or high-fidelity sound home entertainment systems, including television sets, come equipped with connections for the operation of a remote pair of speakers. This connection is provided to allow the operation of an additional pair of stereo speakers in the bedroom, study, playroom, etc. A major problem in locating a remote set of speakers is that conventional speaker systems are too large and bulky for placement in these additional rooms in the home, especially when considering that the size of these rooms is somewhat smaller than a den or a living room.

Accordingly, it would be advantageous to provide an extension to the home entertainment system by providing a full range high-fidelity speaker arrangement that can be easily installed within the wall structure of a room. It would also be advantageous to provide a speaker arrangement that mounts in the space between adjacent wall studs positioned on the standard 16 inch centers, and where the speaker enclosure is no greater than the nominal width dimension of a standard 2×4 inch wall stud. Further, it would be advantageous to provide a speaker arrangement that, when mounted into the wall structure, the speaker is substantially flush to the surface of the wall thereby enabling a full range high-fidelity speaker to be provided without interfering with the open space of the room.

SUMMARY OF THE INVENTION

In accordance with this invention, a speaker arrangement suitable for mounting in the wall structure of a wall is provided. The speaker arrangement consists of a bass reflex speaker enclosure constructed of a low resonant particle or fiber board material in which the depth dimension of the enclosure is no greater than the nominal width dimension of a standard 2×4 inch wall stud. Included with the enclosure is a plurality of stereophonic speakers of varying frequency response characteristics to produce the high-fidelity sound. At least one woofer speaker providing low frequency response, at least one mid-range speaker providing mid-range frequency response and at least one tweeter speaker for providing the high frequency response is mounted to the front surface of the speaker enclosure. Also provided is a hole for permitting the enclosure to achieve the high-fidelity sound reproduction.

A cross-over network is included with the plurality of speakers for the bandpass filtering of the electrical signal to the speakers so that each speaker of a given frequency response substantially receives only those frequencies of the electrical signal that are within its response range. The speaker enclosure further includes an acoustic sound absorber positioned to the rear of the speakers to reduce the amount of sound reflected from the rear of the enclosure. In one embodiment of the invention, the sound absorber is a 1½ inch sheet of convoluted urethane foam that exhibits internal dampening characteristics.

A mounting assembly adapted for mounting between adjacent wall studs is also provided. The mounting assembly is secured to at least one of the wall studs and receives therein the speaker enclosure. The mounting assembly has a depth that is substantially equal to the depth of the speaker enclosure and has a width dimension that is substantially equal to the nominal inside spacing between the adjacent wall studs for a standard stud spacing.

A trim frame assembly is provided for mounting to the exterior surface of the wall covering to hide the mounting assembly positioned in the wall structure and to provide an aesthetic finish to the speaker opening in the wall. The speaker enclosure is covered by a removable cover grille consisting of a frame that is covered with a standard stereo speaker material that will not inhibit the quality of the sound projected into the room. Mounted to the exterior periphery of the speaker enclosure are projections which are used to mount the removable cover grille. The removable grille contains a set of holes that receive the projections to permit the grille to be attached to the speaker enclosure.

Also provided with the speaker arrangement is a remote located volume control that is used to vary the amount of electrical power applied to the speakers. Included with the mounting assembly is a speaker lead passageway which will enable the speaker leads to be attached to the speaker enclosure before the enclosure is inserted into the mounting assembly. The speaker enclosure is inserted into the mounting assembly and secured therein by gluing. Fully mounted into the wall, the exterior surface of the speaker arrangement of the present invention gives the appearance of being substantially flush to the surface of the wall, yet is able to achieve a full range high-fidelity sound reproduction without transmitting sound into the common or adjacent walls.

BRIEF DESCRIPTION OF THE DRAWINGS

For a fuller understanding of the nature and advantages of the invention, reference should be had to the following detailed description taken in connection with the accompanying drawings, in which.

Similar reference characters refer to similar parts throughout the several views of the drawings.

DETAILED DESCRIPTION OF THE PREFERRED EMBODIMENT

Figures 1, 2:
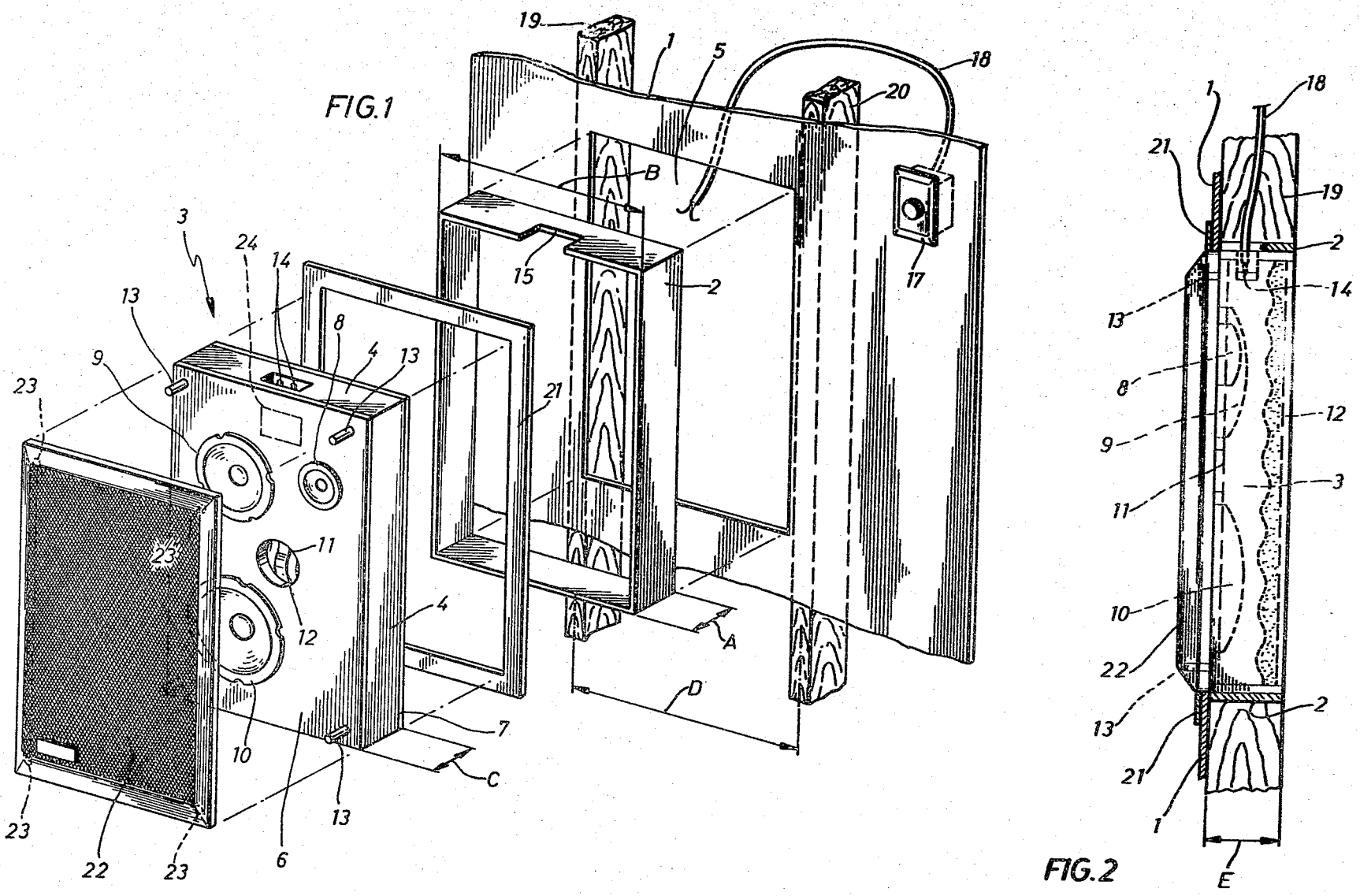
FIG. 1 is an exploded isometric view of the present invention.
FIG. 2 is a side view of the speaker arrangement of the present invention as mounted into the wall structure.

Turning now to the figures, and first to FIG. 1, an exploded isometric view of the speaker arrangement of the present invention is shown. A cut-away section of a wall 1 is shown in which two adjacent wall studs 19 and 20 consisting of standard 2×4 inch studs are spaced apart by a center-to-center distance D. The actual distance between the studs for most walls is approximately 14 inches when the studs are on standard 16 inch centers. However, recent building plans have called for larger and larger stud spacings to minimize the amount of materials that go into the construction of a wall. In any event, the speaker arrangement of the present invention is equally applicable to whatever stud spacing may exist.

Wall 1 contains an opening 5 substantially exposing the spacing between studs 19 and 20. A speaker enclosure mounting assembly 2 whose outside dimension B permits the mounting assembly to be positioned in the nominal spacing between the studs 19 and 20 is inserted into opening 5. The depth of dimension A of mounting assembly 2 is no greater than the nominal width dimension of a standard 2×4 inch stud. Accordingly, when the mounting assembly 2 is placed in the opening 5, the mounting assembly 2 will not extend past the depth of the wall and interfere with common wall surfaces.

In the preferred embodiment, mounting assembly 2 is securely fastened to at least one of the studs 19, 20 by nailing, gluing, screwing, stapling, etc., to provide support for the speaker enclosure 3 that is received within the mounting assembly 2. Mounting assembly 2 further includes a speaker lead passageway 15 that is cut through the top portion of the mounting assembly to permit passage of the speaker lead 18 from the volume control unit 17. Volume control unit 17 is mounted externally to the hole 5. In this manner, the speaker lead 18 may be attached to the speaker enclosure prior to the insertion of enclosure 3 into the mounting assembly 2.

The opening of hole 5 in wall 1 has been framed with a trim frame 21 to cover the installed mounting assembly 2 that has been positioned between the studs, as well as covering up the ragged edges of the hole. Trim frame 21 provides a neat and visually attractive trim to the mounted speaker arrangement.

The speaker assembly 3 is of a known design referred to as a bass reflex speaker enclosure that contains a plurality of speakers to produce the high-fidelity sound reproduction. In such a speaker enclosure, a woofer speaker 10 is provided to produce low frequency audio signals, a mid-range speaker 9 is provided to produce audio frequencies in the intermediate range and a tweeter speaker 8 is provided to produce the high frequencies. In the preferred embodiment, the woofer speaker is an 8 inch shallow basket speaker manufactured by U.S. Pioneer Corporation No. A20EU80-01F, and which has the following electrical specifications:

| | |
|---|---|
| Nominal Impedence | 8 ohms |
| Voice Coil Diameter | 1 (inch) |
| Nominal Resonant Frequency (FO) | 45–50 Hz |
| Nominal Sensitivity | 99 (DB/W) |
| Response Range | FO-14 3000 Hz |
| Total Flux | 33,700 Maxwell |
| Flux Density | 9000 Gauss. |

The mid-range speaker is a 5 inch closed back speaker manufactured by U.S. Pioneer Corporation No. A11D60-02F, and which has the following electrical specifications.

| | |
|---|---|
| Nominal Impedence | 8 ohms |
| Voice Coil Diameter | ¾(inch) |
| Nominal Resonant Frequency (FO) | 700 Hz |
| Response Range | 700–6000 Hz |
| Total Flux | 22,400 Maxwell |
| Flux Density | 7,600 Gauss. |

The tweeter speaker is a 3 inch Phenolic Ring speaker manufactured by U.S. Pioneer Corporation No. B45DP70-01F, and which has the following electrical specifications.

| | |
|---|---|
| Nominal Impedence | 8 ohms |
| Voice Coil Diameter | ¾(inch) |
| Cross-over Frequency (FO) | 2000 Hz |
| Nominal Sensitivity | 100 (DB/W) |
| Response Range | 200–20,000 Hz |
| Total Flux | 32,900 Maxwell |
| Flux Density | 9,970 Gauss. |

It will be obvious to a person of ordinary skill in the art that a speaker enclosure could consist of a different combination of the various speakers above-identified in order to achieve the desired power output and intensity of sound reproduction. For example, three woofers, three mid-range and two tweeter speakers could be combined into speaker enclosure 3 to enable a greater sound intensity to be produced. Included in speaker enclosure 3 is a through hole 11 that is cut through the front mounting plate 6 in order to achieve the high-fidelity sound reproduction characteristic of a bass reflex enclosure. As seen in FIG. 1, acoustic absorbing material 12 can be seen through hole 11. This acoustic absorbing material is attached to the back plate 7 of speaker enclosure 3 to absorb as much as possible of the acoustic energy that is directed towards the back plate 7. For the preferred embodiment, a 1½ inch thick sheet of convoluted urethane foam is used for the acoustic absorbing material 12.

Also included with the speaker enclosure 3 is a set of speaker lead connection points 14 that are recessed below the top surface of top plate 4 to provide a connection point for the speaker leads, and at the same time, is recessed below the surface to avoid any interference by the connection points 14 with the mounting assembly 2. The cutout 15 in mounting assembly 2 enables the speaker lead 18 to pass through the mounting assembly and connect to the speaker enclosure 3 while the enclosure is contained within the mounting assembly. Mounted to the front plate 6 and located to the periphery of enclosure 3 are a set of protrusions 13 commonly referred to as Christmas trees. These projections will enable the cover grille 22 to be removably mounted to the speaker enclosure 3. The depth dimension C of the speaker enclosure 3 is no greater than the nominal width of a standard 2×4 inch stud such that when the speaker enclosure 3 is contained within the mounting assembly 2, the speaker enclosure will not extend past the depth of the wall studs.

Still referring to FIG. 1, the detachable cover grille 22 consists of a frame over which an acoustic material suitable for covering speakers has been placed. The color and texture of the fabric is chosen to be compatible with the color of the trim and the wall to give the overall appearance, when installed in a wall, as a continuation of the surface of the wall. Mounted in cover grille 22 are receiving holes 23 that are spaced apart for receiving and gripping the Christmas trees 13 on the speaker assembly 3. In this manner, the speaker grille can be detachably mounted to the speaker enclosure.

Turning now to FIG. 2, a side view of the speaker arrangement of the present invention as installed in the wall structure is shown. The dimension E is the nominal width dimension of a standard 2×4 inch stud, and as seen in FIG. 2, the installed speaker arrangement does not extend past the depth of the stud. Because the mounting assembly 2 is rigidly secured to only one of the studs, it is possible to provide a single width speaker enclosure 3 to handle those situations where the centering of the studs 19 and 20 are not on the expected spacing interval. In other words, if stud 20 is slightly further from stud 19 than would normally be expected, securing mounting assembly 2 to stud 19 would provide the structural support needed, and since the interior dimensions of mounting assembly 2 is constructed to receive the speaker enclosure 3, variations in the wall stud spacing will not cause a problem. It will be obvious to a person of ordinary skill in the art that the height of the speaker enclosure 3 may be varied as required to accommodate the various plurality of speakers to achievve any desired sound reproduction quality by way of the speaker enclosure.

Figure 3:
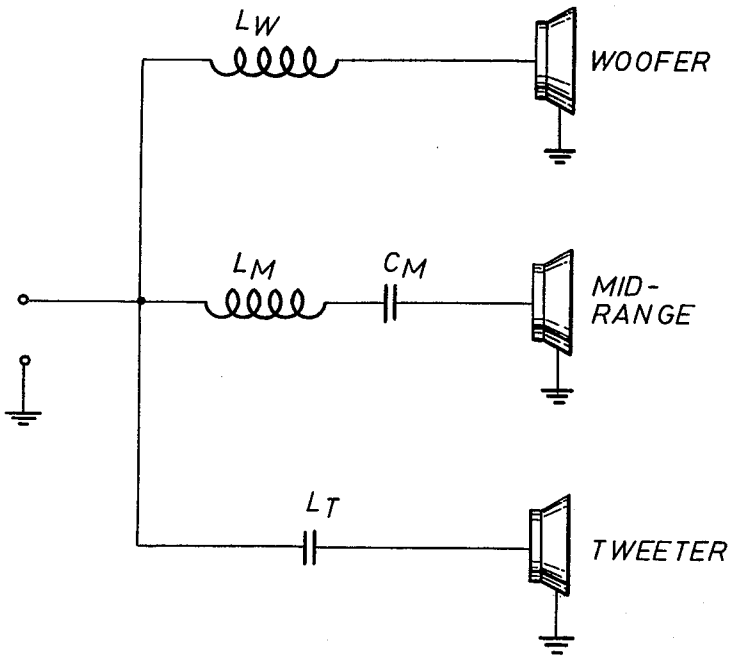
FIG. 3 is a circuit diagram of the cross-over network of the present invention.

Referring now to FIG. 3, the cross-over network 24 that divides the frequency content of the incoming electrical speaker signal into three or more frequency bands for each of the embodiments of the speaker assembly is shown. The bands are chosen to be the frequency response bands of the three types of speakers mounted in the speaker assembly 3. In other words, the low frequency band is applied to the woofer speaker 10, the middle band to the mid-range speaker 9 and the high frequencies to the tweeter 8. In this manner, each of the speakers receives substantially only those frequencies in the electrical speaker signal that are within the response range of the individual speakers. It will be appreciated by those skilled in the art that by proper selection of the frequency bands to be applied to the various speakers, one can achieve any number of variations in the quality of the sound reproduced by the speaker assembly 3. For the preferred embodiment, the cross-over network for the speaker enclosure assembly illustrated in FIG. 1, the following specifications are applicable:

| | |
|---|---|
| Nominal Impedence | 8 ohms 6DB/OCT |
| Cross-over Frequencies | 850 Hz and 5 KHz |
| Frequency Response | 45 Hz to 20 KHz |
| Power Handling Capacity | 30 Watts. |

As previously mentioned, the preferred embodiment of the present invention as illustrated in FIG. 1 consists of three speakers, one 8 inch in diameter, one 5 inch in diameter and one 3 inch in diameter, comprising the plurality of speakers in speaker enclosure 3. Two alternate embodiments include an embodiment having two 8 inch diameter speakers, one 5 inch diameter speaker and two 3 inch diameter speakers. For such an embodiment, the cross-over network will have the following specifications:

| | |
|---|---|
| Nominal Impedence | 8 ohms 6DB/OCT |
| Cross-over Frequencies | 850 Hz, 4 KHz and 5 KHz |
| Frequency Response | 30 Hz to 20 KHz |
| Power Handling Capacity | 50 Watts. |

In the other alternate embodiment, the speaker enclosure 3 will consist of three 8 inch speakers, two 5 inch speakers and three 3 inch speakers. For such an embodiment, the cross-over network specification will be as follows:

| | |
|---|---|
| Nominal Impedence | 8 ohms 6DB/OCT |
| Cross-over Frequencies | 850 Hz, 3 KHz, 5 KHz and 6 KHz |
| Frequency Response | 20 Hz to 20 KHz |

-continued

| | |
|---|---|
| Power Handling Capacity | 80 Watts. |

In describing the invention, reference has been made to the preferred embodiment. However, those skilled in the art and familiar with the disclosure of the invention may recognize additions, deletions, substitutions or other modifications which would fall within the perview of the invention as defined in the appended claims. For example, the trim frame could be attached to the removable cover grille rather than to the exterior surface of wall 1. Additionally, the mounting assembly 2 could be adjustable in width to enable attachment to both adjacent wall studs regardless of stud spacing. It is obvious to a person of ordinary skill in the art that various ways of producing an adjustable mounting frame 2 may be obtained.

What is claimed is:

1. A high-fidelity speaker arrangement suitable for mounting in a wall structure comprising:

(a) a bass reflex speaker enclosure having, (i) a plurality of speakers of varying frequency response characteristics to produce the high-fidelity sound, (ii) a cross-over network for band pass filtering the audio electrical signal to the speakers whereby each speaker of given frequency response substantially receives only those frequencies of the signal that are within its response range, the depth dimension of said enclosure no greater than the nominal width of a standard wall stud, and (iii) an acoustic sound absorber positioned to the rear of said speakers, for reducing the amount of sound reflected from the rear of said enclosure;

(b) a removable cover grille for covering the said speaker enclosure;

(c) a mounting assembly adapted for mounting between adjacent wall studs and secured to at least one of the wall studs, for receiving said speaker enclosure therein, said assembly having a depth dimension substantially equal to the depth of said speaker enclosure and a width dimension substantially equal to the nominal inside spacing between the adjacent wall studs for a standard stud spacing; and (d) a trim frame mounted to the exterior surface of the wall, for covering said mounting assembly, said removable cover grille fitting inside said frame thereby making the exterior surface of the wall mounted speaker arrangement appear to be a part of the surface of the wall.

2. The speaker arrangement of claim 1 wherein said plurality of speakers comprises:

(a) at least one woofer speaker, for providing low frequency sound reproduction of the high-fidelity sound;

(b) at least one mid-range speaker, for providing mid-range frequency sound reproduction of the high-fidelity sound; and (c) at least one tweeter speaker, for providing high frequency sound reproduction of the high-fidelity sound.

3. The speaker arrangement of claim 1 wherein said trim frame is mounted to said cover grille rather than to the surface of the wall.

4. The speaker arrangement of claim 1 wherein said mounting assembly further includes a speaker lead passageway therethrough to permit the connection of the speaker leads to said speaker enclosure prior to its insertion into the mounting assembly.

5. The speaker arrangement of claim 1 wherein said speaker enclosure is secured within said mounting assembly by gluing.

6. A full range high-fidelity speaker arrangement suitable for mounting in a wall between adjacent wall studs whereby the mounted speaker arrangement gives the appearance of being substantially a continuation of the surface of the wall, and where the high-fidelity sound is projected outwardly from the wall and not into common or adjacent walls, the arrangement comprising:

(A) a speaker assembly including,
  (a) a bass reflex enclosure having,
    (1) a front plate, said plate having mounted thereon,
      (i) a plurality of speakers, for generating the high-fidelity sound,
      (ii) at least one hole passing therethrough, and
      (iii) a plurality of projections spaced around the periphery of the plate and protruding above the surface,
    (2) a back plate spaced apart from said front plate by side plates such that the depth dimension of the enclosure is equal to the nominal wall depth dimension of a standard 2×4 inch stud, said back panel having mounted thereon and contained between said front and said rear panels a sheet of convoluted urethane foam having internal dampening characteristics, said front, said back and said side panels fastened together to form a closed assembly, and
    (3) a cross-over network, for dividing the frequency content of the high-fidelity sound such that each speaker substantially receives only frequencies within its respective frequency response range, and
  (b) a detachable cover grille substantially equal in outside dimensions to said front plate and having mounting holes therein for grippingly receiving the projections of said front plate to enable the cover grille to be mounted to said front plate;
(B) a mounting assembly having an outside dimension substantially equal to the nominal inside spacing between adjacent wall studs and positionable therebetween, for securely receiving therein said speaker assembly, said mounting assembly having a speaker lead passageway therethrough to permit the connection of the speaker leads to said speaker assembly prior to its insertion into the mounting assembly; and
(C) a trim frame mounted to the exterior surface of the wall, for covering said mounting assembly, said removable cover grille fitting inside said frame thereby making the exterior surface of the wall mounted speaker arrangement appearing to be substantially a part of the surface of the wall.

7. The speaker arrangement of claim 6 wherein said mounting assembly is securely fastened to at least one wall stud.

8. The speaker arrangement of claim 6 wherein said plurality of speakers comprises:
  (a) at least one woofer speaker, for providing low frequency sound reproduction of the high-fidelity sound;
  (b) at least one mid-range speaker, for providing mid-range frequency sound reproduction of the high-fidelity sound; and
  (c) at least one tweeter speaker, for providing high frequency sound reproduction of the high-fidelity sound.

9. The speaker arrangement of claim 6 wherein said front, said back and said side plates are constructed of low resonant particle or fiber board material.

10. The speaker arrangement of claim 6 wherein said bass reflex enclosure further comprises quick-disconnect connection points for attaching the speaker leads to said speaker assembly.

11. The speaker arrangement of claim 6 wherein said cross-over network further includes a volume control controlling the amount of audio signal power delivered to said speakers.

12. The speaker arrangement of claim 6 wherein said trim frame is mounted to said detachable cover grille rather than to the exterior surface of the wall.

* * * * *

UNITED STATES PATENT AND TRADEMARK OFFICE

CERTIFICATE OF CORRECTION

PATENT NO. : 4,296,280

DATED : October 20, 1981

INVENTOR(S) : Ronald A. Richie

It is certified that error appears in the above—identified patent and that said Letters Patent is hereby corrected as shown below:

Column 3, line 51, delete "14".

Column 4, line 8, delete "200" and insert --2000--.

Column 5, line 14, delete "achievve" and insert --achieve--.

Signed and Sealed this

*Twentieth* Day of *April 1982*

[SEAL]

*Attest:*

GERALD J. MOSSINGHOFF

*Attesting Officer*

*Commissioner of Patents and Trademarks*